US008438691B1

(12) United States Patent
Kingdon

(10) Patent No.: US 8,438,691 B1
(45) Date of Patent: May 14, 2013

(54) GRILL CLEANING ASSEMBLY

(76) Inventor: William C. Kingdon, Moreno Valley, CA (US)

( * ) Notice: Subject to any disclaimer, the term of this patent is extended or adjusted under 35 U.S.C. 154(b) by 0 days.

(21) Appl. No.: 13/269,660

(22) Filed: Oct. 10, 2011

(51) Int. Cl.
*A47L 13/08* (2006.01)
*A47L 17/00* (2006.01)

(52) U.S. Cl.
USPC ..... 15/236.01; 15/236.05; 15/236.06; 15/236.09

(58) Field of Classification Search ..... 15/236.01, 15/236.05, 236.06, 236.09
See application file for complete search history.

(56) References Cited

U.S. PATENT DOCUMENTS 2,291,015 A * 7/1942 Anderson ..... 30/171
2,810,144 A * 10/1957 McIntosh ..... 15/105
2,824,323 A 2/1958 Tos et al.
D247,278 S 2/1978 Dunn, Jr.
4,471,985 A 9/1984 Mahoney
4,958,403 A 9/1990 Martin
5,373,600 A 12/1994 Stojanovski et al.
D455,272 S 4/2002 Zemel
D497,483 S 10/2004 Bock
7,039,983 B1 5/2006 Outlaw

* cited by examiner

*Primary Examiner* — Randall Chin

(57) ABSTRACT

A grill cleaning assembly for cleaning the bottom side of a grill includes an arm that has a first end and a second end. A blade has an attached end, a free end, a top side, a bottom side, a first lateral edge and a second lateral edge. The blade has a trapezoidal cross-section taken perpendicular to a line which extends through the attached and free ends such that the top side has a lesser width extending between the first and second lateral edges than the bottom side. Each of the first and second lateral edges slopes from a top end to a bottom end of the trapezoidal shape. The free end is configured to be inserted between a pair of bars of a grill and such that either the first or second lateral edges abuts and is moved across a lower side of the bars.

4 Claims, 4 Drawing Sheets

GRILL CLEANING ASSEMBLY

BACKGROUND OF THE DISCLOSURE

Field of the Disclosure

The disclosure relates to grill cleaning devices and more particularly pertains to a new grill cleaning device for cleaning the bottom side of a grill.

SUMMARY OF THE DISCLOSURE

An embodiment of the disclosure meets the needs presented above by generally comprising an arm that has a first end and a second end. A blade is provided that has an attached end, a free end, a top side, a bottom side, a first lateral edge and a second lateral edge. The attached end is attached to the second end. The blade extends away from the arm at a right angle. The blade has a trapezoidal cross-section taken perpendicular to a line which extends through the attached and free ends such that the top side has a lesser width extending between the first and second lateral edges than the bottom side. Each of the first and second lateral edges slopes from a top end to a bottom end of the trapezoidal shape. The blade is comprised of a rigid material. A handle is attached to the first end. The free end is configured to be inserted between a pair of bars of a grill and such that either the first or second lateral edges abuts and is moved across a lower side of the bars.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
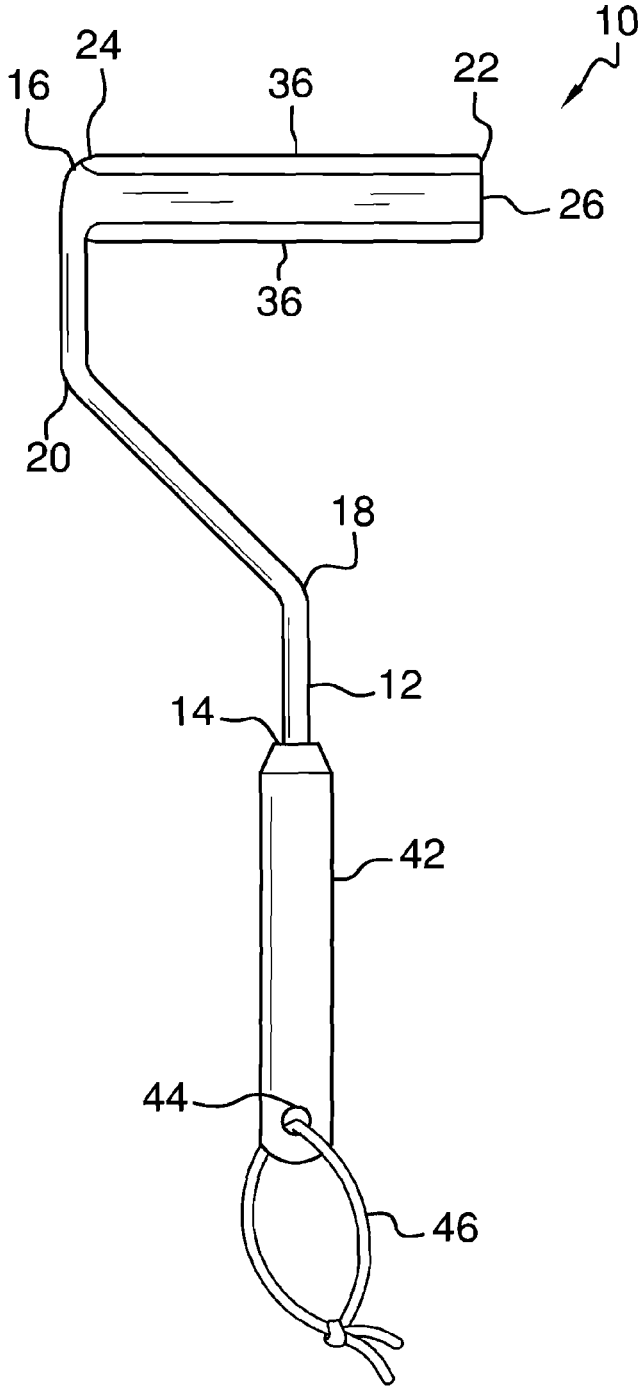
FIG. 1 is a top view of a grill cleaning assembly according to an embodiment of the disclosure.
Figure 2:
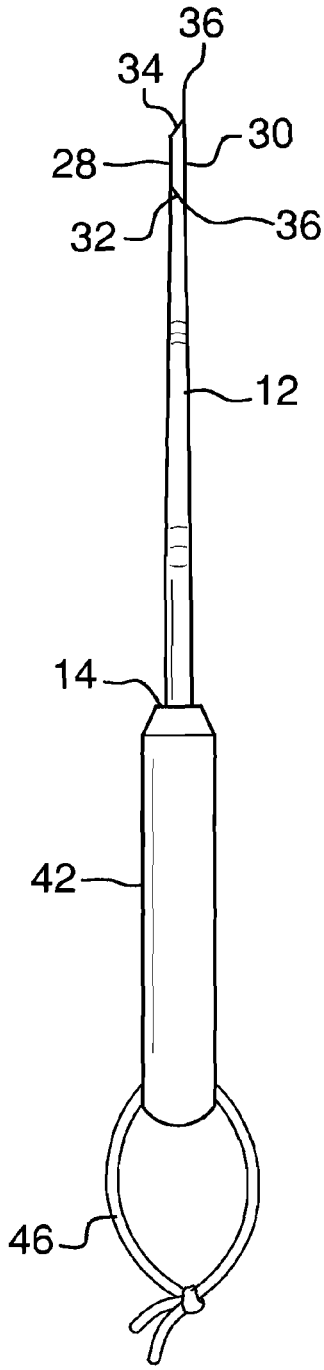
FIG. 2 is a side view of an embodiment of the disclosure.
Figure 3:
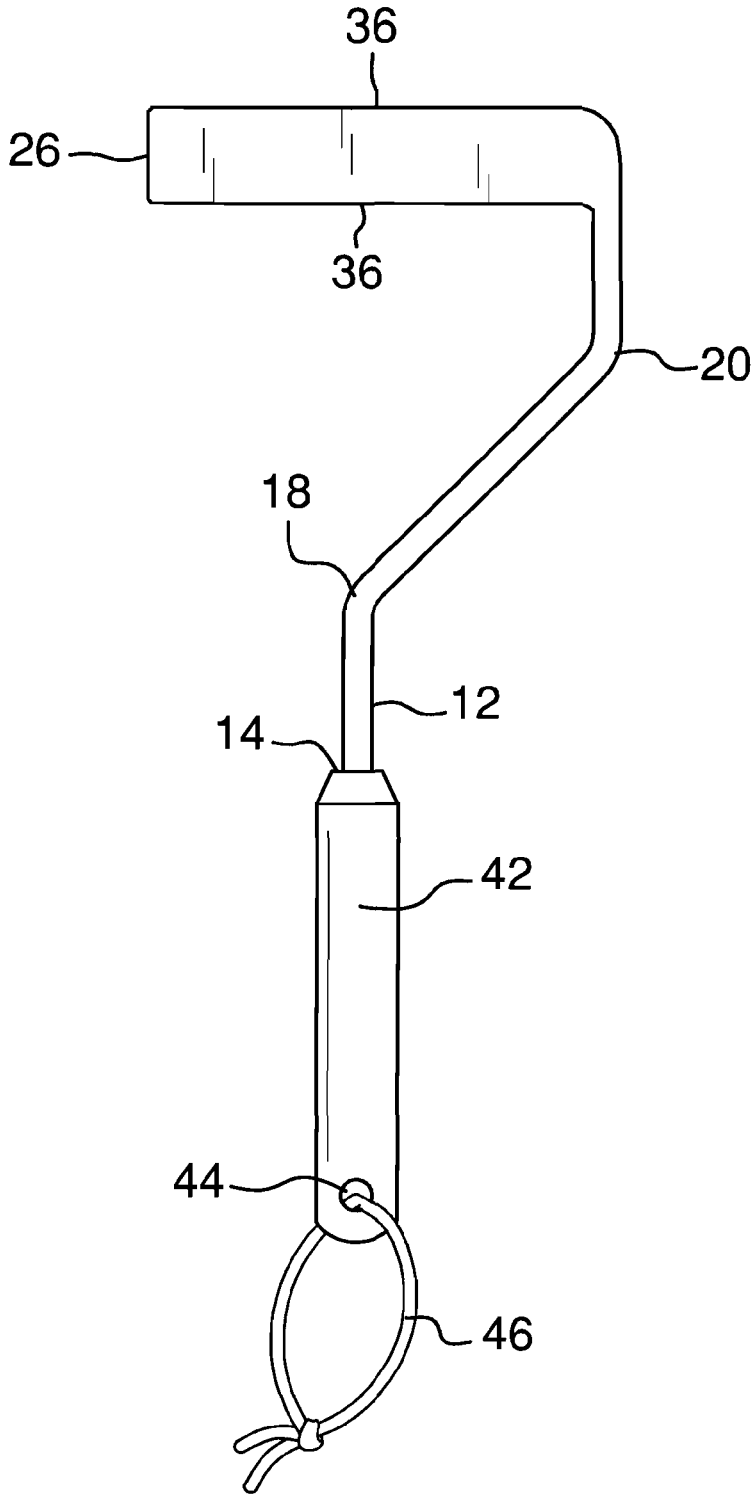
FIG. 3 is a bottom view of an embodiment of the disclosure.
Figure 4:
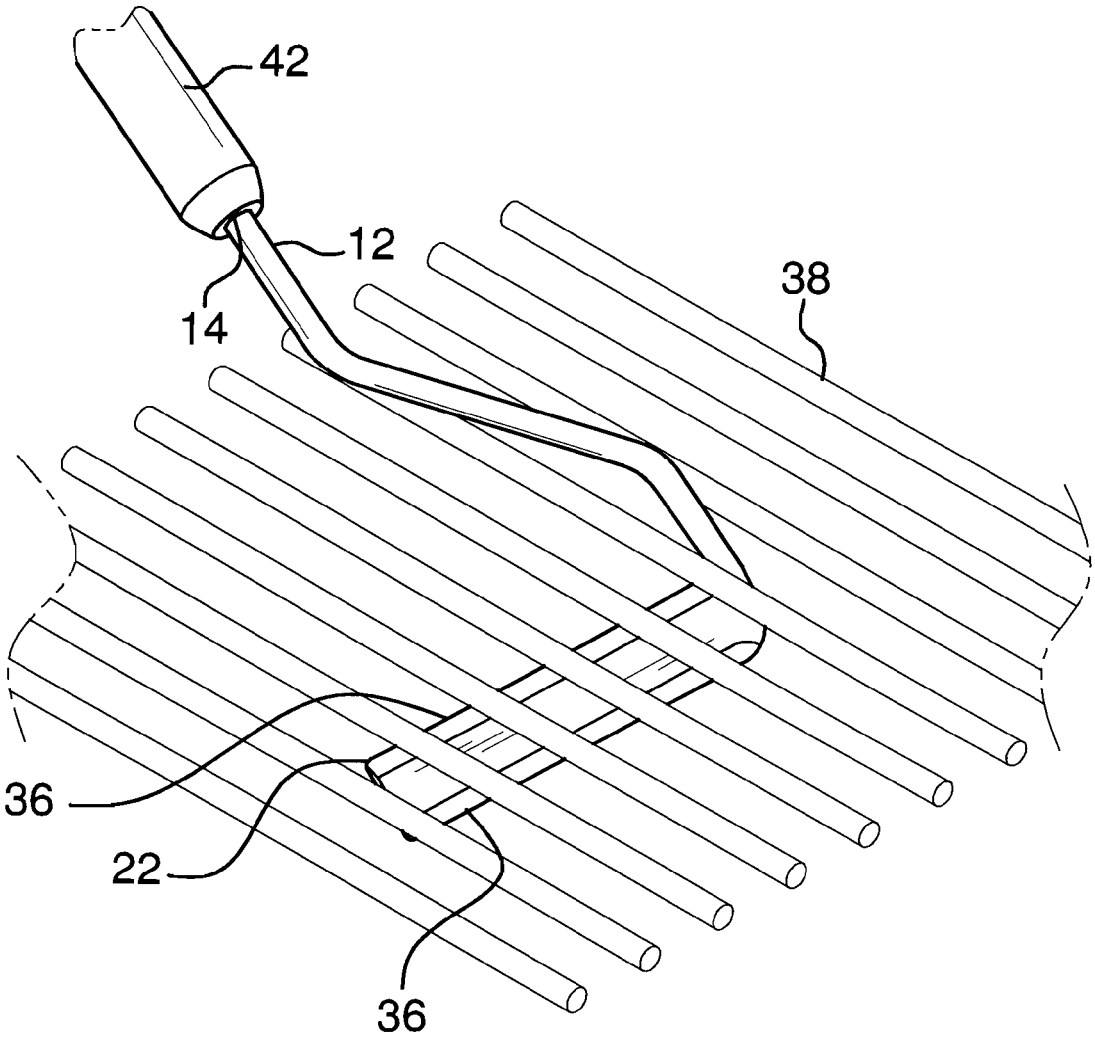
FIG. 4 is an in-use view of an embodiment of the disclosure.
Figure 5:
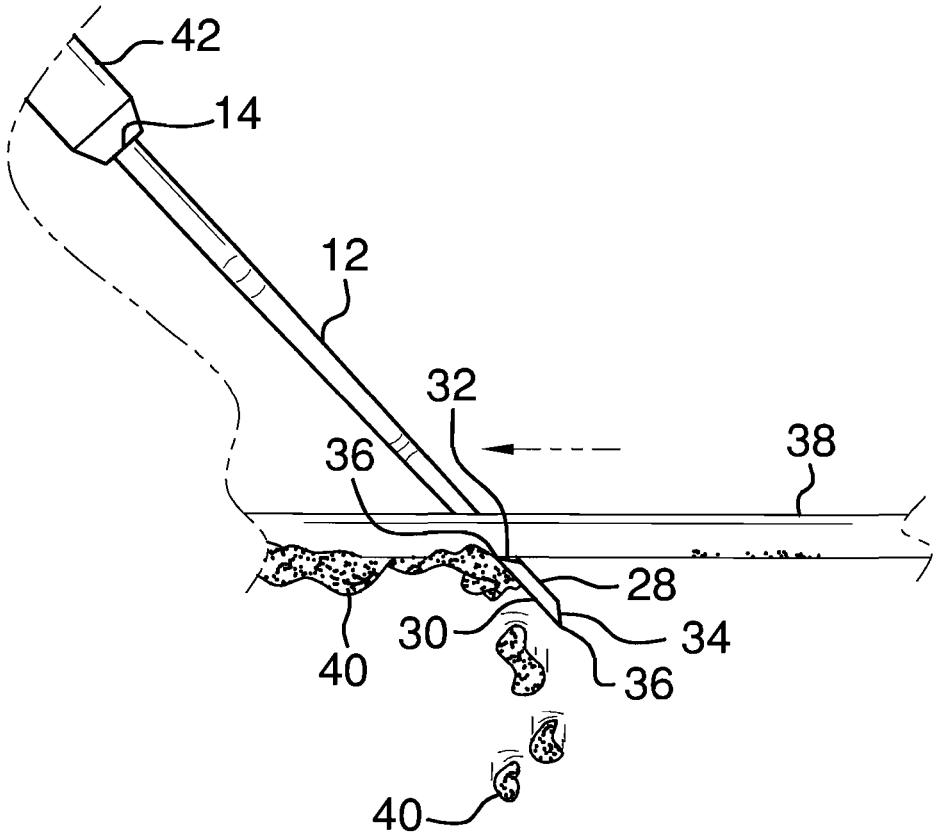
FIG. 5 is an alternative in-use view of an embodiment of the disclosure.

With reference now to the drawings, and in particular to FIGS. 1 through 5 thereof, a new grill cleaning device embodying the principles and concepts of an embodiment of the disclosure and generally designated by the reference numeral 10 will be described.

As best illustrated in FIGS. 1 through 5, the grill cleaning assembly 10 generally comprises an arm 12 that has a first end

14, a second end 16, a first bend 18 and a second bend 20. The first bend 18 is nearer to the first end 14 than the second end 16 and the first bend 18 forms an obtuse angle. The second bend 20 is nearer to the second end 16 than the first end 14 and the second bend 20 forms an obtuse angle that is congruent with the first bend 18. The arm 12 may be comprised of a rigid material such as steel, aluminum or other similar material.

A blade 22 is provided that has an attached end 24, a free end 26, a top side 28, a bottom side 30, a first lateral edge 32 and a second lateral edge 34. The blade has a length from the attached end 24 to the free end between 8.0 cm and 18.0 cm and a height from the top side 28 to the bottom side between 0.3 cm and 2.0 cm. The attached end 24 is attached to the second end 16 and the blade 22 extends away from the arm 12 at a right angle. The blade 22 has a trapezoidal cross-section taken perpendicular to a line which extends through the attached 24 and free 26 ends such that the top side 28 has a lesser width extending between the first 32 and second 34 lateral edges than the bottom side 30. Each of the first 32 and second 34 lateral edges slopes from a top end to a bottom end of the trapezoidal shape, forming the sharp edges 36 of the blade 22. A line extending through the first end 14 and the first bend 18 bisects the blade 22, giving the blade 22 a balanced weight when being used. The free end 26 of the blade 22 is configured to be inserted between a pair of bars 38 of a grill and such that either the first 32 or second 34 lateral edges abuts and is moved across a lower side of the bars 38, allowing the sharp edges 36 of the blade 22 to remove debris 40 from the lower side of the bars 38. The blade 22 may be comprised of a rigid material such as steel, aluminum or other similar material.

A handle 42 is attached to the first end 14. The handle 42 has an aperture 44 extending therethrough located on a lower end of the handle 42. The handle may be comprised of a rigid material such as wood or other similar material. A loop 46 passes through the aperture 44 configured for hanging the handle 42 on a hook. The loop 46 may be comprised of a flexible material such as leather or other similar material.

In use, the blade 22 is inserted between a pair of bars 38 on a grill so one of the first 32 or second 34 lateral edges abuts the lower side of the bars 38. The blade may be moved back and forth so the sharp edges 36 of the blade 22 remove debris 40 from the lower side of the bars 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A grill cleaning assembly configured for cleaning the bottom side of a grill, said assembly comprising:

an arm having a first end and a second end;

a blade having an attached end, a free end, a top side, a bottom side, a first lateral edge and a second lateral edge, said first and second lateral edges extending between said attached and free ends, said attached and free ends extending between said top side and said bottom side, said attached end being attached to said second end such that said blade extends away from said arm in a single direction, said blade extending away from said arm at a right angle, said blade having a trapezoidal cross-section taken perpendicular to a line extending through said attached and free ends such that said top side has a lesser width extending between said first and second lateral edges than said bottom side, each of said first and second lateral edges sloping from a top end to a bottom end of the trapezoidal, said blade being comprised of a rigid material;

a handle being attached to said first end; and wherein said free end is configured to be inserted between a pair of bars of a grill and such that either said first or second lateral edges abuts and is moved across a lower side of the bars.

2. The assembly according to claim 1, where said arm has a first bend and a second bend, said first bend being nearer to said first end than said second end, said first bend forming an obtuse angle, said second bend being nearer to said second end than said first end, said second bend forming an obtuse angle being congruent with said first bend.

3. The assembly according to claim 1, further including:

said handle having an aperture extending therethrough; and a loop passing through said aperture configured for hanging said handle on a hook.

4. A grill cleaning assembly configured for cleaning the bottom side of a grill, said assembly comprising:

an arm having a first end, a second end, a first bend and a second bend, said first bend being nearer to said first end than said second end, said first bend forming an obtuse angle, said second bend being nearer to said second end than said first end, said second bend forming an obtuse angle being congruent with said first bend, said arm being comprised of a rigid material;

a blade having an attached end, a free end, a top side, a bottom side, a first lateral edge and a second lateral edge, said attached end being attached to said second end, said blade extending away from said arm at a right angle, said blade having a trapezoidal cross-section taken perpendicular to a line extending through said attached and free ends such that said top side has a lesser width extending between said first and second lateral edges than said bottom side, each of said first and second lateral edges sloping from a top end to a bottom end of the trapezoidal, said blade being comprised of a rigid material;

wherein a line extending through said first end and said first bend bisects said blade;

a handle being attached to said first end, said handle having an aperture extending therethrough, said handle being comprised of a rigid material;

a loop passing through said aperture configured for hanging said handle on a hook; and wherein said free end is configured to be inserted between a pair of bars of a grill and such that either said first or second lateral edges abuts and is moved across a lower side of the bars.

* * * * *